US011420663B2

(12) United States Patent
Wydotis et al.

(10) Patent No.: US 11,420,663 B2
(45) Date of Patent: Aug. 23, 2022

(54) SYSTEM AND METHOD FOR PROVIDING RAILROAD GRADE CROSSING STATUS INFORMATION TO AUTONOMOUS VEHICLES

(71) Applicant: Siemens Mobility, Inc., New York, NY (US)

(72) Inventors: Leonard Wydotis, Marion, KY (US); Jose Tondi Resta, Louisville, KY (US)

(73) Assignee: Siemens Mobility, Inc., New York, NY (US)

( * ) Notice: Subject to any disclaimer, the term of this patent is extended or adjusted under 35 U.S.C. 154(b) by 373 days.

(21) Appl. No.: 16/497,712

(22) PCT Filed: Mar. 31, 2017

(86) PCT No.: PCT/US2017/025340
§ 371 (c)(1),
(2) Date: Sep. 25, 2019

(87) PCT Pub. No.: WO2018/182679
PCT Pub. Date: Oct. 4, 2018

(65) Prior Publication Data

US 2021/0284213 A1 Sep. 16, 2021

(51) Int. Cl.
*B61L 29/24* (2006.01)
*B61L 29/22* (2006.01)
(Continued)

(52) U.S. Cl.
CPC ..... *B61L 29/246* (2013.01); *B61L 29/22* (2013.01); *B61L 29/24* (2013.01); *B61L 29/28* (2013.01); *B61L 29/30* (2013.01); *B61L 29/32* (2013.01)

(58) Field of Classification Search
CPC ..... B61L 29/22; B61L 29/246; B61L 29/32; B61L 29/28; B61L 29/30; B61L 2205/04
(Continued)

(56) References Cited

U.S. PATENT DOCUMENTS 5,554,982 A 9/1996 Shirkey et al.
5,620,155 A * 4/1997 Michalek ..... B61L 29/24 246/121
(Continued)

FOREIGN PATENT DOCUMENTS

DE 102015209671 A1 12/2016
JP 2000280910 A 10/2000
(Continued)

OTHER PUBLICATIONS

PCT International Search Report and Written Opinion of International Searching Authority dated Nov. 30, 2017 corresponding to PCT International Application No. PCT/US2017/025340 filed Mar. 31, 2017.

*Primary Examiner* — Zachary L Kuhfuss

(57) ABSTRACT

A railroad communication system (100, 200) includes a wayside control device (130) in communication with one or more railroad crossing warning device(s) (140, 145) located at a railroad grade crossing (125), wherein the one or more railroad crossing warning device(s) (140, 145) are activated in response to a signal of the wayside control device (130). An autonomous motor vehicle (150) approaches the railroad grade crossing (125), wherein the wayside control device (130) is configured to communicate information in response to an activation of the one or more railroad crossing warning device(s) (140, 145), and wherein the autonomous motor vehicle (150) is configured to receive the information.

18 Claims, 3 Drawing Sheets

(51) Int. Cl.
*B61L 29/32* (2006.01)
*B61L 29/30* (2006.01)
*B61L 29/28* (2006.01)

(58) Field of Classification Search
USPC ..... 246/125, 473.1, 293
See application file for complete search history.

(56) References Cited

U.S. PATENT DOCUMENTS

| | | | | |
|---|---|---|---|---|
| 5,735,491 | A * | 4/1998 | Atkinson | B61L 29/246 246/124 |
| 2014/0166820 | A1* | 6/2014 | Hilleary | B61L 29/246 246/125 |
| 2014/0263857 | A1* | 9/2014 | Huntimer | B61L 29/246 246/122 R |

FOREIGN PATENT DOCUMENTS

| | | | |
|---|---|---|---|
| JP | 2002274384 | A | 9/2002 |
| WO | 2011123885 | A1 | 10/2011 |

* cited by examiner

SYSTEM AND METHOD FOR PROVIDING RAILROAD GRADE CROSSING STATUS INFORMATION TO AUTONOMOUS VEHICLES

BACKGROUND

1. Field

Aspects of the present invention generally relate to systems and method for providing railroad grade crossing status information to autonomous vehicles.

2. Description of the Related Art

Railroad grade crossings, sometimes referred to in the U.K. as level crossings, are locations at which railroad tracks intersect roads. Avoiding collisions between people, trains and automobiles at grade crossings has always been a matter of great concern in the railroad industry.

Warning systems have been developed to warn people and cars of an approaching train at a grade crossing. A constant warning time device, also referred to as a grade crossing predictor (GCP) in the U.S. or a level crossing predictor in the U.K., is an electronic device that is connected to the rails of a railroad track and is configured to detect the presence of an approaching train and determine its speed and distance from a railroad grade crossing. The constant warning time device will use this information to generate constant warning time signal(s) for controlling crossing warning device(s). A crossing warning device is a device that warns of the approach of a train at a crossing, examples of which include crossing gate arms (e.g., the familiar red and white striped wooden or fibreglass arms often found at highway grade crossings to warn motorists of an approaching train), crossing lights (such as the red flashing lights often found at highway grade crossings in conjunction with the crossing gate arms discussed above), and/or crossing bells or other audio alarm devices.

A more recent development in train safety has been the use of positive train control (PTC) systems on board locomotives. These systems are designed to prevent collisions between trains, to enforce speed restrictions, and to perform other safety-related functions. Although these systems vary widely in their implementation, many of them share common characteristics such as a positioning systems and map databases that allow a locomotive to determine its position relative to a track system and communications system that allow the locomotive to communicate with devices located off of the train. For example, it is known in the art to utilize such locomotive PTC systems as a means to ensure that a train does not pass a grade crossing when a warning system is malfunctioning.

To date, automobiles or motor vehicles approaching a railroad grade crossing do not know the status of the railroad grade crossing until the crossing is within the view of the approaching driver of the vehicle. This is especially troublesome for emergency vehicles when the crossing is blocked for example by a stopped train and has been for some time. In addition, even when motorists do see an active railroad grade crossing, they receive visual indications that a train is coming via the flashing lights and/or gate arms, but they do not know when the train will be at the crossing, which direction it is coming from nor do they know the speed at which the train is travelling. Thus, in order to improve vehicular safety, there exists a need to provide information to motorists about the status of the railroad grade crossing and the approaching railway vehicles before the crossing becomes visible to the motorists.

SUMMARY

Briefly described, aspects of the present invention relate to a system and method for providing railroad grade crossing status information to autonomous vehicles. The term 'railroad crossing' is also known and herein referred to as 'railroad grade crossing', 'grade crossing' or simply 'crossing'.

A first aspect of the present invention provides a railroad communication system comprising a wayside control device in communication with at least one railroad crossing warning device located at a railroad grade crossing, the at least one railroad crossing warning device being activated in response to a signal of the wayside control device, and an autonomous vehicle approaching the railroad grade crossing, wherein the wayside control device is configured to communicate information in response to an activation of the at least one railroad crossing warning device, and wherein the autonomous vehicle is configured to receive the information.

A second aspect of the present invention provides a method for providing railroad grade crossing status information to an autonomous vehicle comprising activating at least one railroad crossing warning device of a railroad grade crossing in response to a signal of a wayside control device, providing and transmitting information that the at least one railroad crossing warning device has been activated via a communication network, and receiving the information by an autonomous motor vehicle approaching the railroad grade crossing.

DETAILED DESCRIPTION

To facilitate an understanding of embodiments, principles, and features of the present invention, they are explained hereinafter with reference to implementation in illustrative embodiments. In particular, they are described in the context of being railroad communication systems and method for providing railroad grade crossing status information to autonomous vehicles. Embodiments of the present invention, however, are not limited to use in the described devices or methods.

The components and materials described hereinafter as making up the various embodiments are intended to be illustrative and not restrictive. Many suitable components and materials that would perform the same or a similar function as the materials described herein are intended to be embraced within the scope of embodiments of the present invention.

Figure 1:
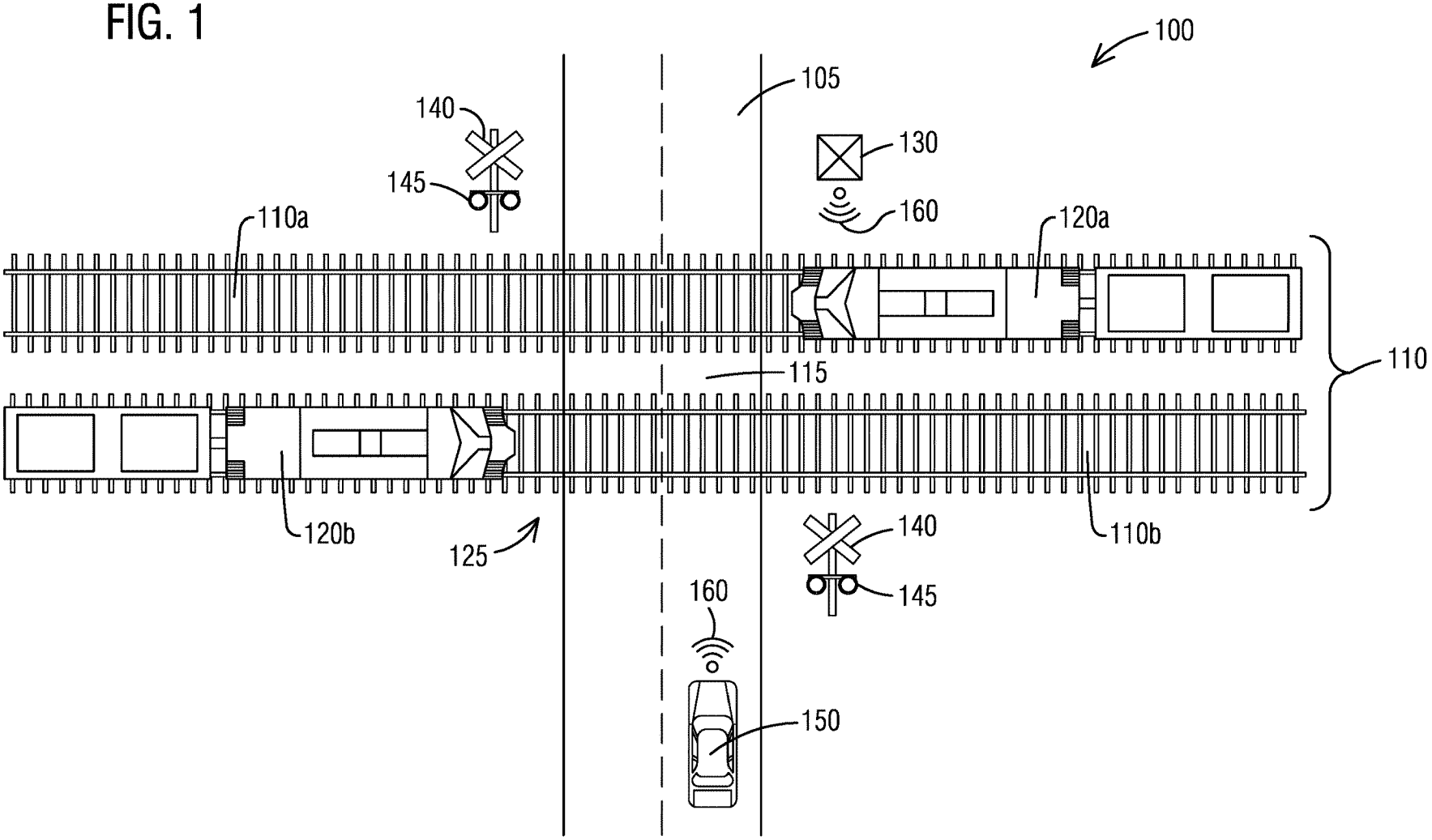
FIG. 1 illustrates an embodiment of a railroad communication system in accordance with an exemplary embodiment of the present invention disclosed herein.

FIG. 1 illustrates an embodiment of a railroad communication system 100 in accordance with an exemplary embodiment of the present invention disclosed herein. The system 100 is provided at a railroad grade crossing 125, herein also referred to as crossing 125, a location where a road 105 crosses a railroad track 110. The crossing 125 of the road 105 and the railroad track 110 forms an island 115. The railroad track 110 includes two rails 110*a*, 110*b*. A first railroad vehicle 120*a* is travelling on track 110*a*, and a second railroad vehicle 120*b* is travelling on track 110*b*. Both railroad vehicles 120*a*, 120*b* are approaching the crossing 125, wherein the railroad vehicles 120*a*, 120*b* travel in opposite directions. The railroad vehicles 120*a*, 120*b* are herein also referred to as trains 120*a*, 120*b*.

The system 100 includes a wayside control device 130. The wayside control device 130 is illustrated as one component, but can comprise multiple components which together form the wayside control device 130. The wayside control device 130 is typically located in proximity to the crossing 125. In an exemplary embodiment, the wayside control device 130 is configured as a constant warning time device, also referred to as GCP or GCP system. It should be noted that one of ordinary skill in the art is familiar with a constant warning time device, and its components, functionality and mode of operation will not be described in detail herein. In short, the wayside control device 130 (GCP) includes a control unit connected to transmitter and receiver lines, which are coupled to the rails 110*a*, 110*b*, wherein the control unit includes logic, which may be implemented in hardware, software, or a combination thereof, for calculating train speed, distance and direction, and producing constant warning time signals for the crossing 125.

FIG. 1 further illustrates one or more railroad crossing warning devices, also referred to as grade crossing warning devices, which warn of the approach of a railroad vehicle, for example the trains 120*a*, 120*b*, at the crossing 125. The railroad crossing warning devices include for example a railroad crossbuck 140, crossing lights 145, and/or other devices not illustrated herein, as for example a crossing gate arm with (or without) gate arm lights spaced along the arm, crossing bells or other audio alarm devices. The crossing warning devices 140, 145 are in communication with the wayside control device 130. As noted before, the wayside control device 130 produces constant warning time signals for the crossing 125, and is in communication with the warning devices 140, 145 located at the railroad grade crossing 125. The railroad crossing warning devices 140, 145 are activated and/or deactivated in response to signal(s) of the wayside control device 130.

FIG. 1 further illustrates an autonomous motor vehicle 150 approaching the railroad grade crossing 125. FIG. 1 illustrates only one vehicle 150, but it should be noted that there may be multiple vehicles 150 approaching the crossing 125 from different directions. Autonomous vehicles 150 can include for example motor vehicles such as cars, motorbikes, trucks, buses etc. But it should be noted that the vehicle 150 may also represent pedestrians or bicyclists, or other traveling objects which are not motor vehicles, if they are adapted to participate in the communication systems 100 (or communication system 200 of FIG. 2) described herein. An autonomous vehicle 150 represents an independent vehicle or traveling object other than the railway vehicles 120*a*, 120*b* approaching the crossing 125, for example by road 105.

As described before, the vehicle 150, i.e. the driver/passengers of the vehicle 150, do not know the status of a railroad grade crossing 125 until the crossing 125 is within the view of the driver of the approaching vehicle 150. Further, the vehicle 150 does not know when the trains 120*a*, 120*b* will be at the crossing 125, which direction they are coming from, or a speed at which the trains 120*a*, 120*b* are traveling. In order to improve vehicular safety, it is beneficial to provide information to the vehicle 150 about the status of the railroad grade crossing 125 as well as the trains 120*a*, 120*b* in advance before to crossing 125 becomes visible to the vehicle 150.

In accordance with an exemplary embodiment, the wayside control device 130 is configured to communicate information in response to an activation of the railroad crossing warning devices 140, 145, wherein the autonomous vehicle 150 is configured to receive the information. In other words, as soon as the wayside control device 130, for example GCP, detects and determines that the trains 120*a*, 120*b* are approaching the crossing 125 and produces the signal(s) to activate the warning devices 140, 145, the wayside control device 130 also communicates or transmits information about the status of the crossing 125 via a communication network. The information about the status of the crossing 125 is herein also referred to as crossing information or crossing status information.

In accordance with an exemplary embodiment, the crossing information is communicated or transmitted via a first wireless communication network 160 that is adapted to transmit data, wherein the wayside control device 130 and the vehicle 150 interface with the wireless communication network 160. In an embodiment, the first wireless communication network 160 utilizes a 5.9 GHz frequency band allocated by the Federal Communications Commission (FCC) for Intelligent Transportation Systems (ITS), IEEE 802.11. Alternatively, the first wireless communication network 160 can utilize Bluetooth technology standard, or some other means of dedicated short-range communication. Dedicated short-range communications are one-way or two-way short-range to medium-range wireless communication channels specifically designed for automotive use and a corresponding set of protocols and standards.

The wayside control device 130 is configured to transmit the crossing information via the network 160 and therefore comprises a type of transmitting unit which may be implemented in hardware, software, or a combination thereof, for transmitting or communicating the crossing information.

The autonomous vehicle 150 is configured to receive the information via the first wireless communication network 160 and therefore comprises a type of receiving unit that may be implemented in hardware, software, or a combination thereof. Further, the vehicle 150 comprises a messaging unit for providing the received information to the driver/passengers of the vehicle 150. The messaging unit can provide an audio message or a visual message. The receiving unit and the messaging unit may be combined as one unit, for example the messaging unit may be included in the receiving unit. The receiving unit and the messaging unit may be separate units. For an audio message, the messaging unit can be included in a radio or Global Positioning System (GPS) of the vehicle 150 using speaker(s) of the radio. A visual message may be displayed on a display or screen of the vehicle 150. Such a display or screen may be provided in connection with a GPS system of the vehicle 150. The receiving unit is configured to receive the information from the wayside control device 130 and to process the information. Processing can mean that the information is at least read and forwarded to the messaging unit for providing the message. Processing can also mean that the received information from the wayside control device 130 is transformed into a different format such as audio or visual format.

The crossing information transmitted or communicated by the wayside control device 130 via the wireless communication network 160 includes information which is already existing and available in the wayside control device 130. As described before, the wayside control device 130 detects the presence of the approaching trains 120*a*, 120*b*, determines their speed and distance from the railroad crossing 125, and calculates when the trains 120*a*, 120*b* will arrive at the crossing 125. This information or data is now transmitted or communicated, wherein the vehicle 150 receives and/or processes these information or data.

The information comprises information that the crossing 125 and/or railroad crossing warning devices 140, 145 are activated, which includes a crossing identification/location, and which can further include activation duration. The information can further comprise data relating to the railroad vehicle(s) 120*a*, 120*b* approaching the railroad grade crossing 125, such as for example railroad vehicle speed, direction of railroad vehicle, proximity of railroad vehicle, estimated time of arrival of railroad vehicle at the railroad grade crossing, time the railroad vehicle takes to pass the railroad grade crossing, and a combination thereof. The data relating to the railroad vehicle(s) 120*a*, 120*b* is herein also referred to as train data. This way, information that is already being provided by the wayside control device 130 is used to provide relevant safety, warning, and/or convenience information to vehicle(s) 150. An example of an audio message via speaker(s) of a radio of the vehicle 150 can be for example: "You are approaching an active railroad crossing on Main Street. A train is traveling westbound at 45 MPH and will be at the crossing in 4 seconds. A second train is traveling eastbound at 35 MPH and will be at the crossing in 20 seconds. The crossing has been activated for 31 seconds. Please use caution and be prepared to STOP".

Figure 2:
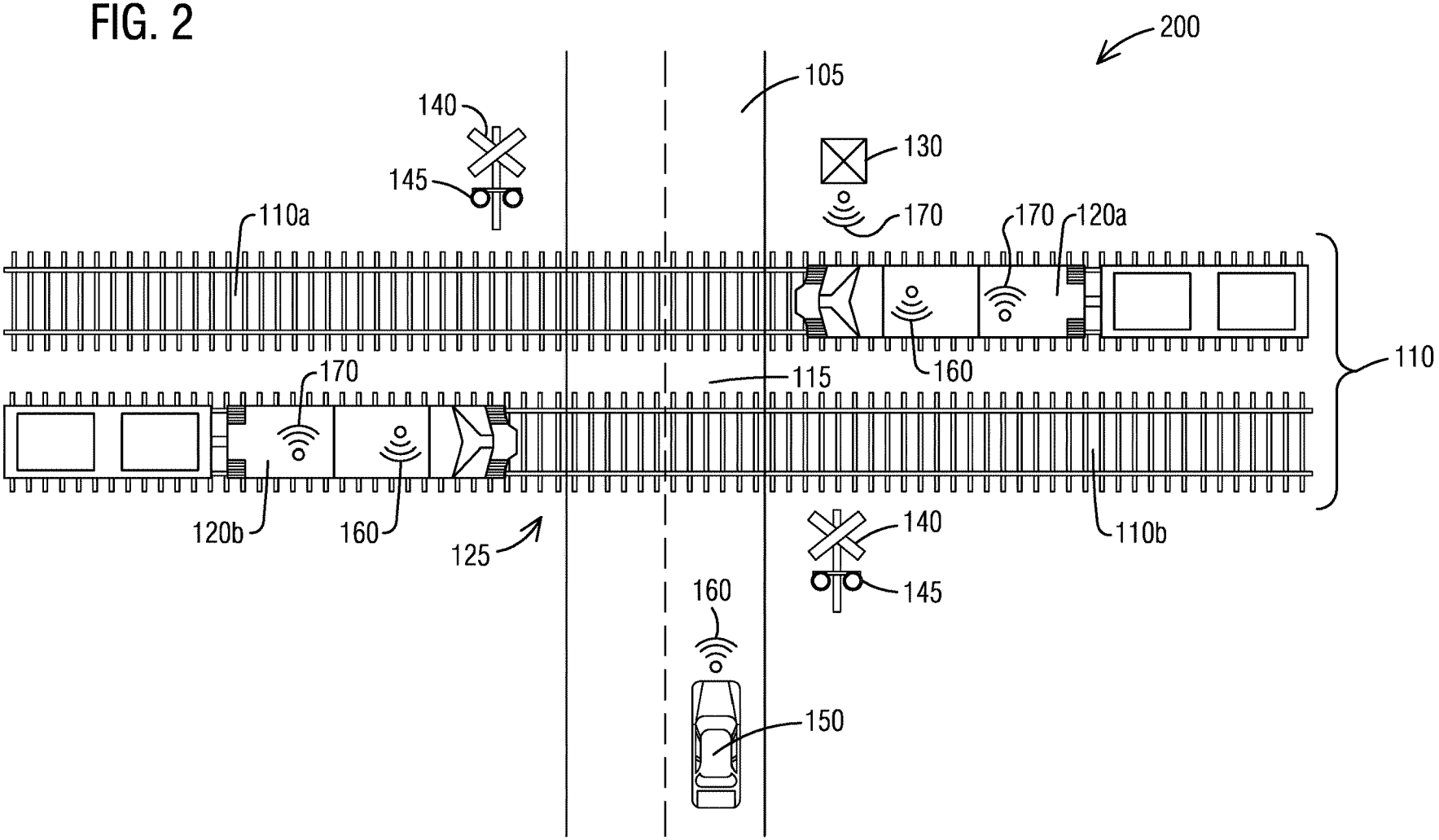
FIG. 2 illustrates another embodiment of a railroad communication system in accordance with an exemplary embodiment of the present invention.

FIG. 2 illustrates another embodiment of a railroad communication system 200 in accordance with an exemplary embodiment of the present invention. The system 200 of FIG. 2 comprises similar components or structure as the communication system 100 of FIG. 1, wherein same reference numbers of system 100 label same components in the system 200.

Both communication systems 100, 200 are used to convey crossing status information of the railroad grade crossing 125 and data of the approaching trains 120*a*, 120*b* to the autonomous vehicle 150. As described with reference to communication system 100 of FIG. 1, the information of the crossing 125 and data of approaching trains 120*a*, 120*b* is communicated via the first wireless network 160 between the wayside control device 130 and the autonomous vehicle 150. In the embodiment according to FIG. 2, the crossing status information and train data is communicated using multiple networks 160, 170 and via the approaching train(s) 120*a*, 120*b* as will be described.

According to the communication system 200 described with reference to FIG. 2, the railway vehicles 120*a*, 120*b* are equipped with Positive Train Control (PTC) systems. PTC systems are train control systems for monitoring and controlling train movements as an attempt to provide increased safety. Typically, PTC systems use Global Positioning System (GPS) navigation to track train movements and to provide for example the location of the train 120*a*, 120*b*, also for example in relation to railroad grade crossings. Further, based on the PTC system and GPS, the trains 120*a*, 120*b* are able to provide real-time data of speed, direction and location of the trains 120*a*, 120*b*. It should be noted that PTC systems and GPS are well known in the art and are not described in detail herein.

The wayside control device 130 is in communication with the crossing warning devices 140, 145 and is further adapted to communicate with the trains 120*a*, 120*b* via the PTC systems of the trains 120*a*, 120*b*. The wayside control device 130 may also be referred to as wayside control system which is a known term in the art. A wayside control system typically comprises multiple components such as control units for communicating and controlling railroad crossings and/or railroad vehicles. A wayside control system may include a GCP, but comprises more functionality and complexity than the GCP since for example the wayside control system is able to communicate with the PCT system of trains.

The railroad communication system 200 comprises the first wireless communication network 160, and further comprises a second wireless communication network 170. The first wireless communication network 160 utilizes for example the 5.9 GHz frequency band allocated by the Federal Communications Commission (FCC) for Intelligent Transportation Systems (ITS), IEEE 802.11, Bluetooth technology standard, or some other means of dedicated short-range communication. The first wireless communication network 160 is used to receive communicated crossing information and train data by the vehicle 150 as described before with reference to the system 100. The first wireless communication network 160 further interfaces with the railroad vehicles 120*a*, 120*b*. The crossing status information and train data is communicated by the railroad vehicle (s) 120*a*, 120*b* to the autonomous vehicle 150 via the first wireless communication network 160.

The second wireless communication network 170 interfaces with the wayside control device 130 and the trains 120*a*, 120*b* and is adapted to transmit data, in particular crossing information, from the wayside control device 130 to the trains 120*a*, 120*b*. These crossing status information, which includes for example that the crossing 125 and warning devices 140, 145 have been activated is transmitted to the trains 120*a*, 120*b*. The crossing information is supplemented with train data, such as for example train speed, train direction and train location, provided by the trains 120*a*, 120*b*, using their PTC systems. The combined crossing status information (provided by the wayside control device 130) and the train data (provided by the trains 120*a*, 120*b*) is communicated by the trains 120*a*, 120*b* to the vehicle 150. Thus, the trains 120*a*, 120*b* interface with both communication networks 160, 170, via their on board PTC systems. In an exemplary embodiment, the second wireless communication network 170 utilizes a dedicated 220 MHz wireless network, allocated by the FCC for land mobile communications. Thus, real-time updates of the train's speed, direction and exact GPS location are provided to both the wayside control device 130 and operators of the railway vehicle 120*a*, 120*b*.

The communication system 200 utilizes PTC information and data available and existing on board the trains 120*a*, 120*b* and transmits these information/data to the vehicle(s) 150. As described before, the vehicle 150 is configured to receive the information and therefore comprises a type of receiving unit that may be implemented in hardware, software, or a combination thereof. Further, the vehicle 150 comprises a messaging unit for providing the received information to the driver/passengers of the vehicle 150, wherein the messaging unit can provide an audio message or a visual message.

Figure 3:
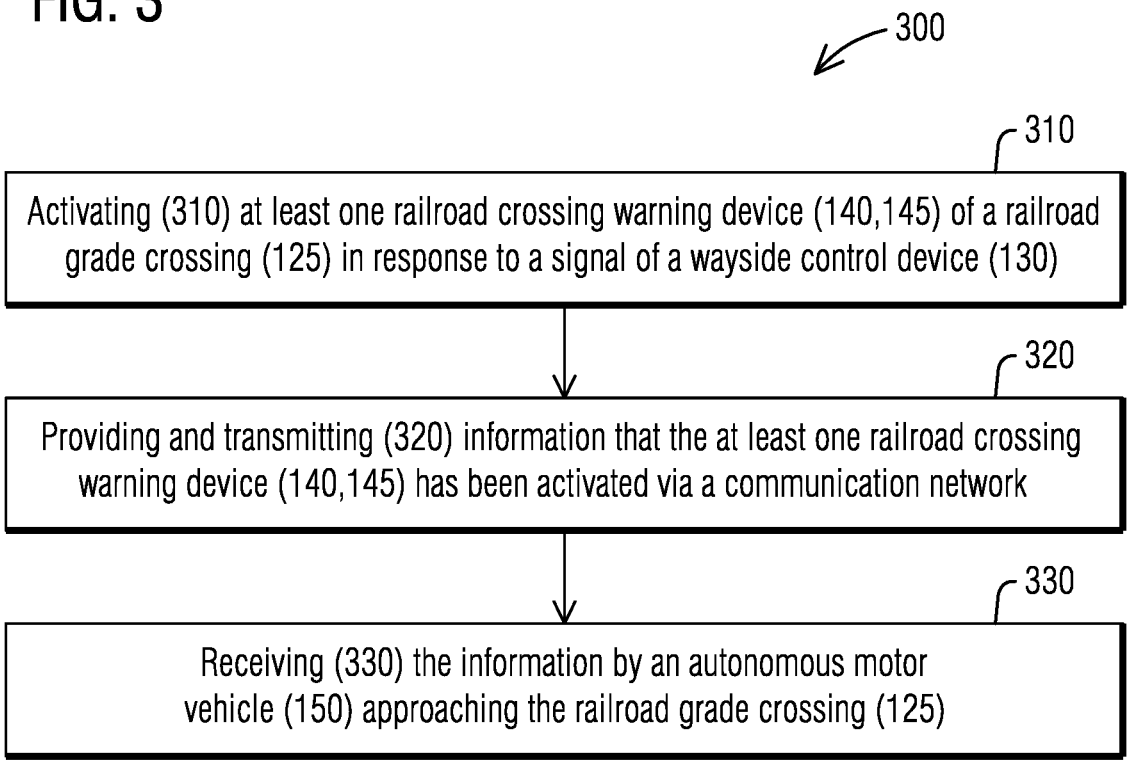
FIG. 3 illustrates a flow chart of a method for providing railroad grade crossing status information to autonomous vehicles in accordance with an exemplary embodiment of the present invention.

FIG. 3 illustrates a flow chart of a method 300 for providing railroad grade crossing status information to autonomous vehicles in accordance with an exemplary embodiment of the present invention. The method 300 relates to the systems 100, 200 and refers to the components/elements described with reference to these systems.

In step 310, a railroad grade crossing 125 with at least one railroad crossing warning device 140, 145 located at the crossing 125 is activated in response to a signal of a wayside control device 130. Crossing information that the crossing 125 has been activated is provided and transmitted via a communication network (step 320), and the information is received and processed by an autonomous motor vehicle 150 approaching the railroad crossing 125 (step 330). The information further comprises train data of trains 120*a*, 120*b* approaching the crossing 125. The crossing information and train data are either transmitted by the wayside control device 130 or the railway vehicles 120*a*, 120*b* for reception by the vehicle 150. One or more wireless communication networks 160, 170 are used to transmit the information and data to the vehicle 150. The crossing information comprises crossing status information such as that the crossing 125 has been activated and an activation duration. The train data comprises at least train speed, train direction and estimated time of arrival of railroad vehicle at the railroad grade crossing 125. In an embodiment, the trains 120*a*, 120*b* can comprise on board PTC systems configured to communicate with the wayside control device 130 and to provide real-time data of the trains speed, direction and exact location of the trains 120*a*, 120*b*.

By the communication systems 100, 200 and the method 300 it is not only communicated to vehicle(s) (including motorists or other traveling objects) that a railroad crossing is activated. Further, advanced information is provided so that vehicle(s) is advised of an estimated time of arrival (ETA) of railway vehicle(s) to the crossing, the approaching train's direction and speed, whether or not a second train is also approaching the crossing (if there are multiple tracks) and alert the vehicle of a duration of time that the crossing has been activated (activation duration). Understanding how long the crossing has been activated can advise emergency response personnel that a train may be blocking the crossing so they can consider taking an alternate route before they get to the crossing, greatly improving their response time to the emergency. In addition, providing motorists with this level of information significantly reduces the number of grade crossing collisions that occur each year simply by providing them with crossing information well in advance of their vehicle crossing the railroad tracks.

While embodiments of the present invention have been disclosed in exemplary forms, it will be apparent to those skilled in the art that many modifications, additions, and deletions can be made therein without departing from the spirit and scope of the invention and its equivalents, as set forth in the following claims.

The invention claimed is:

1. A railroad communication system comprising:

a grade crossing predictor in communication with at least one railroad crossing warning device located at a railroad grade crossing, the at least one railroad crossing warning device being activated in response to a signal of the grade crossing predictor, and an independent vehicle approaching the railroad grade crossing, one or more wireless communication network(s) interfacing with the grade crossing predictor, the independent vehicle and a railroad vehicle approaching the railroad grade crossing, wherein, utilizing the one or more wireless communication network(s), crossing status information is communicated by the grade crossing predictor to the railroad vehicle, wherein the crossing status information is supplemented with train data by the railway vehicle using an on-board Positive Train Control (PTC) system, and wherein, utilizing the one or more wireless communication network(s), combined crossing status information with the train data is communicated by the railway vehicle to the independent vehicle.

2. The railroad communication system of claim 1, wherein the one or more wireless communication networks comprise a first wireless communication network interfacing with the independent vehicle and the railroad vehicle, and a second wireless communication network interfacing with the grade crossing predictor and a railroad vehicle approaching the railroad grade crossing.

3. The railroad communication system of claim 2, wherein the first wireless communication network utilizes a 5.9 GHz frequency band.

4. The railroad communication system of claim 2, wherein the first wireless communication network utilizes Bluetooth technology standard or a dedicated short-range communication network.

5. The railroad communication system of claim 2, wherein the second wireless communication network comprises a dedicated 220 MHz wireless network.

6. The railroad communication system of claim 1, wherein the crossing status information comprises information that the at least one railroad crossing warning device is activated.

7. The railroad communication system of claim 1, wherein the train data relating to the railroad vehicle approaching the railroad grade crossing is selected from a group consisting of railroad vehicle speed, direction of railroad vehicle, proximity of railroad vehicle, estimated time of arrival of railroad vehicle at the railroad grade crossing, time the railroad vehicle takes to pass the railroad grade crossing, and a combination thereof.

8. The railroad communication system of claim 1, wherein the train data relating to the railroad vehicle comprise real-time data of speed, direction and location of the railroad vehicle.

9. The railroad communication system of claim 8, wherein the railroad vehicle comprises and utilizes the PTC system for providing the real-time data of speed, direction and location of the railroad vehicle.

10. The railroad communication system of claim 1, wherein the independent vehicle comprises a messaging unit for providing an audio message or visual message.

11. The railroad communication system of claim 1, wherein the grade crossing predictor comprises a constant warning time device in communication with a railroad track.

12. A method for providing railroad grade crossing status information to an independent vehicle comprising:

activating at least one railroad crossing warning device of a railroad grade crossing in response to a signal of a grade crossing predictor, providing and transmitting crossing status information that the at least one railroad crossing warning device has been activated via one or more wireless communication networks to a railroad vehicle, supplementing the crossing status information with train data by the railroad vehicle using an on-board Positive Train Control (PTC) system, and receiving the crossing status information combined with the train data by an independent vehicle approaching the railroad grade crossing.

13. The method of claim 12, wherein the on-board PTC system is configured to provide real-time data of speed, direction and location of the railway vehicle.

14. The method of claim 12, wherein the one or more wireless communication networks comprise a first wireless communication network interfacing with the independent vehicle and the railroad vehicle, and a second wireless communication network interfacing with the grade crossing predictor and a railroad vehicle approaching the railroad grade crossing.

15. The method of claim 14, wherein the first wireless communication network utilizes a 5.9 GHz frequency band.

16. The method of claim 14, wherein the first wireless communication network utilizes Bluetooth technology standard or a dedicated short-range communication network.

17. The method of claim 14, wherein the second wireless communication network comprises a dedicated 220 MHz wireless network.

18. The method of claim 12, wherein the train data relating to the railroad vehicle approaching the railroad grade crossing is selected from a group consisting of railroad vehicle speed, direction of railroad vehicle, proximity of railroad vehicle, estimated time of arrival of railroad vehicle at the railroad grade crossing, time the railroad vehicle takes to pass the railroad grade crossing, and a combination thereof.

* * * * *